US006634140B1

(12) United States Patent
Sellman

(10) Patent No.: US 6,634,140 B1
(45) Date of Patent: Oct. 21, 2003

(54) AUTOMATIC DOOR OPENER

(75) Inventor: Nils D. Sellman, Simsbury, CT (US)

(73) Assignee: Power Access Corporation, Collinsville, CT (US)

( * ) Notice: Subject to any disclaimer, the term of this patent is extended or adjusted under 35 U.S.C. 154(b) by 0 days.

(21) Appl. No.: 09/952,225

(22) Filed: Sep. 13, 2001

Related U.S. Application Data

(60) Provisional application No. 60/232,296, filed on Sep. 13, 2000.

(51) Int. Cl.[7] ..... E05F 11/24
(52) U.S. Cl. ..... 49/340
(58) Field of Search ..... 49/339, 340

(56) References Cited

U.S. PATENT DOCUMENTS

| | | | | | |
|---|---|---|---|---|---|
| 3,059,485 | A | | 10/1962 | Bohlman et al. | 74/95 |
| 3,609,390 | A | | 9/1971 | Feldman | 307/134 |
| 3,719,005 | A | | 3/1973 | Carli | 49/28 |
| 3,874,117 | A | * | 4/1975 | Boehm | 49/340 |
| 3,955,661 | A | | 5/1976 | Popper et al. | 192/150 |
| 4,289,995 | A | * | 9/1981 | Sorber et al. | 49/334 |
| 4,334,161 | A | | 6/1982 | Carli | 310/68 E |
| 4,342,354 | A | | 8/1982 | Leivenzon et al. | 160/133 |
| 4,472,910 | A | | 9/1984 | Iha | 49/139 |
| 4,644,693 | A | * | 2/1987 | Wang | 49/280 |
| 4,836,345 | A | | 6/1989 | Anderson | 192/20 |
| 4,852,706 | A | | 8/1989 | Pietrzak et al. | 192/8 R |
| 4,945,678 | A | | 8/1990 | Berner et al. | 49/322 |
| 5,018,304 | A | * | 5/1991 | Longoria | 49/340 |
| 5,222,327 | A | | 6/1993 | Fellows et al. | 49/139 |
| 5,698,073 | A | | 12/1997 | Vincenzi | 160/188 |
| 5,808,654 | A | * | 9/1998 | Loos | 347/215 |
| 5,878,530 | A | | 3/1999 | Eccleston et al. | 49/139 |
| 5,881,497 | A | | 3/1999 | Borgardt | 49/139 |
| 5,930,954 | A | * | 8/1999 | Hebda | 49/345 |
| 6,002,217 | A | | 12/1999 | Stevens et al. | 318/9 |

FOREIGN PATENT DOCUMENTS

| | | | |
|---|---|---|---|
| EP | 217228 | * | 9/1986 |
| FR | 2508530 | * | 12/1982 |
| JP | 90431 | * | 4/2001 |

* cited by examiner

*Primary Examiner*—Jerry Redman
(74) *Attorney, Agent, or Firm*—Libert & Associates; Victor E. Libert; Frederick A. Spaeth

(57) ABSTRACT

An automatic door opener (10) for opening or closing a door (28) includes a motor (14) driving a drive shaft (50) and an opener arm (18) connected to the door (28) and being responsive to rotation of the drive shaft (50) for moving the door (28) to an open or closed position. A clutch (46) operable to disengage the drive shaft (50) from the opener arm (18) is provided in the event of the door (28) engaging an obstacle, electric power being unavailable, or the door being fully open or fully closed. The door opener (10) may also include a brake (48) for selectively preventing movement of the door (28). Various embodiments of the invention are provided, including an electromagnetic clutch (80) and an electromagnetic brake (114).

4 Claims, 6 Drawing Sheets

AUTOMATIC DOOR OPENER

CROSS-REFERENCE TO RELATED APPLICATION

This application claims the benefit of U.S. provisional application No. 60/232,296, filed Sep. 13, 2000.

STATEMENT REGARDING FEDERALLY SPONSORED RESEARCH OR DEVELOPMENT

Not Applicable.

BACKGROUND OF THE INVENTION

1. Field of the Invention

The present invention relates generally to automatic side hinge door openers and, more particularly, relates to clutching and braking systems for use in conjunction with automatic door openers suitable for both original installation and easy retrofit onto standard side hinge doors.

2. Related Art

Mechanisms for opening doors and the like are known.

U.S. Pat. No. 5,878,530 to Eccleston et al, dated Mar. 9, 1999 and entitled "Remotely Controllable Automatic Door Operator Permitting Active And Passive Door Operation", discloses a remotely controllable automatic door opener for a side-hinged door. The opener comprises an electronically operated clutch in the gear train between the motor shaft and the opener arm drive shaft (output shaft). An electronic control unit comprising adjustable timers is employed to govern the opening and closing of the door.

U.S. Pat. No. 5,881,497 to Borgardt, dated Mar. 16, 1999 and entitled "Automatic Door Opener Adaptable For Manual Doors", discloses an automatic door opener that employs a slip clutch in the drive train between the motor and the output shaft.

U.S. Pat. No. 6,002,217 to Stevens et al, dated Dec. 14, 1999 and entitled "Door Operating System", discloses a door operating system that employs a dual position feedback system that can help prevent overtravelling of the door when it is being closed.

Other automatic door openers are directed towards opening of garage doors by means of drive chains or worm gears. While such door openers typically have some form of clutch mechanism, the weight of the garage door and the necessity that the garage door be raised vertically on rails require a slip clutch of great torsional capacity and some switching mechanism to stop the motor or interrupt the drive train when the door encounters an obstacle. In such garage door openers, the driven clutch mechanism is a shaft or gear engaging a travel nut or chain.

For example, U.S. Pat. No. 4,334,161 to Carli, dated Jun. 8, 1982 and entitled "Centrifugal Switch And Motor Control", discloses a friction clutch which is best seen in FIG. 1 and is described in column 2, line 62 through column 3, line 5. The friction clutch includes a circular drive member 27, a driven member 28 and a clutch facing 33 located therebetween. The clutch facing 33 is washer-shaped and has apertures that are slidably received on bosses 34 located on the driven member 28. Another washer-shaped component, hard metal disc 35, is secured by staking 36 to the circular drive member 27 and frictionally co-acts with the clutch facing 33. Tension on the driven member 28 is varied by tightening or loosening a nut 42 which maintains a spring 43 adjacent to the driven member. In operation, the door will move under normal operating conditions but may slip upon a definite overload. For example, should the door strike some obstacle or reach the up or down travel limits, the driven member 28 will stop and, in turn, the friction clutch will slip. When the clutch slips, a centrifugal switch mechanism 47 located on the driven member 28 closes, thereby shutting down the motor. Driven member 28 is connected to output shaft 40 which engages partial nut 45 to pull the weight of garage door 13 up track 14. In this arrangement, the clutch (un-numbered) is not by itself a sufficient safety mechanism should the door strike an obstacle such as a human being, thus necessitating centrifugal switch mechanism 47.

U.S. Pat. No. 3,955,661 to Popper et al, dated May 11, 1976 and entitled "Apparatus For Opening And Closing Door Members And The Like", discloses an apparatus for opening and closing doors including a ball drive assembly 56. The ball drive assembly 56 provides a driving connection between the driver shaft 50 and a driven shaft 58 such that the driven shaft 58 is rotatably driven at a predetermined reduced rate of speed compared to the speed of the driver shaft 50. A torque control 90 (best seen in FIG. 3) is provided to sense an obstruction in the path of the door member 14 and to send a stop signal to the motor control 48 via signal path 92. As drive chain 16 must vertically raise door member 14, ball drive assembly 56 provides a substantially increased internal friction as compared to the usual coupling devices such as pulley-belt drives or the like, thereby increasing the amount of force which must be manually applied to the door member 14 to move the door member 14 from a stopped or parked position (column 15, lines 17–28). Popper et al emphasize that the ball drive assembly 56 allows for substantially weaker torque control springs 206 and 210, and thus a more sensitive torque control 90. Torque control 90 shuts off the motor in response to the door member 14 being unable to move.

U.S. Pat. No. 5,222,327 to Fellows et al, dated Jun. 29, 1993 and entitled "Side Mount Garage Door Operator", discloses a side mount garage door opener including a means 17 for selectively connecting and disconnecting the drive shaft 14 with the door opening and closing mechanism 16. A clutch 22 is interposed between the drive shaft 14 and mechanism 16 and is manually operable for disengaging the drive motor from the garage door via a selector member 23 in the absence of electrical power. As illustrated in FIG. 3A, the clutch is shown in the engaged position but may be moved to the disengaged position as illustrated in FIG. 3 via movement of the selector member 23.

U.S. Pat. No. 3,719,005 to Carli, dated Mar. 6, 1973 and entitled "Door Operator Reversing Control", discloses a door operator having a friction clutch (un-numbered) and a one-way clutch 70. The friction clutch is similar to the one described above with respect to the aforementioned U.S. Pat. No. 4,334,161, and includes a clutch plate 24 and clutch disc 25 carrying a clutch lining 26 which frictionally cooperates with the clutch plate 24. The one-way clutch 70 is provided for moving a torque switch means 48 in one particular direction. A torque weight 71 is slidably mounted in an eccentric aperture 72 in a hub bracket 34 and functions, when the motor is reversed, to drive an inner cylindrical surface 79 of a drive disc 45 to establish a particular position of the torque switch means 48. The torque switch means 48 is moved in the opposite direction by a gravity-actuated weight 68. As in U.S. Pat. No. 4,334,161, worm 17 rotates to raise garage door 12.

U.S. Pat. No. 3,059,485 to Bohlman et al, dated Oct. 23, 1962 and entitled "Electro-Mechanical Door Opening And Closing Mechanism", discloses a garage door opener as illustrated in FIGS. 1 and 3, having clutch plates 51 and 60 disposed on each side of one wheel 55. Friction plates 65 convey torque to clutch plates 51 and 60 from one wheel 55, which in turn meshes with worm 77 (FIG. 4) situated on shaft 78 of motor 79. Driven shaft 24 is attached to clutch plates 51 and 60 and in turn rotates drum 30 having two runs of cable (un-numbered) which raise the garage door 46.

U.S. Pat. No. 4,852,706 to Pietrzak et al, dated Aug. 1, 1989 and entitled "Gate Operator", discloses a gate operator including, as illustrated in FIGS. 3, and 5, a clutch assembly 32, a clutch operator member assembly 50 and a clamp head 52. The clutch assembly 32 includes worm wheel 30 and floating pressure plates 34, which drive pressure plates 36 and friction discs 38 and thus drive sprocket 18. Clutch operator member assembly 50 includes Belleville washers 49, collar 58, needle bearing 60 and thrust washer 62. Clamp head 52 is operated by a lever 54 controlled in turn by a screw 70. In operation, the clamp head 52 functions to engage the clutch operator member assembly 50 for tensioning the clutch assembly 32. For example, when it is desired to tension the clutch to increase the load at which the clutch will slip, screw 70 is adjusted whereby clamp head 52 is pivoted causing thrust washer 62 to apply pressure to collar 58. This pressure causes Belleville washers 49 to apply pressure between the various plates of the clutch assembly 32. The gate operator pulls chain 86 to open and close the gate. Clutch operator member assembly 50 may be used to manually engage and disengage clutch assembly 32.

Known swing door operators usually have a type of door closer which automatically closes the door in a power failure. Prior art door openers also include those which are movable only when energized. These devices suffer from the drawback that upon loss of power the door is not easily movable, creating a hazard in the event of a fire. Some require sensors mounted in the motor housing or drive shaft to sense stoppage of the doors by an obstacle, and to disengage the clutch or stop the motor so as to prevent damage to the device or obstacle. Some have a clutch mechanism which must be operated manually.

Accordingly, it is desired to provide a door opener which may open a conventional side hinge door. It is also desired to provide a door opener which allows the door to stop when an obstacle is encountered, without the use of expensive, unreliable sensors, switches, torque controls and the like. It is-also desirable to provide an automatic door opener that is easy to retrofit to existing doors and that provides an easily adjusted range of motion.

SUMMARY OF THE INVENTION

The present invention provides improvements to motorized door openers that comprise a motor having a drive shaft, an opener arm mounted on an output shaft and a clutch in the drive train of the opener. One improvement of this invention comprises that the clutch is mounted on the output shaft. Optionally, the opener arm may be mounted on the drive shaft of the motor, whereby the drive shaft comprises the output shaft. The clutch may be either a slip clutch or an electromagnetic clutch.

Another aspect of this invention relates to an improvement to a door opener mechanism comprising a pivoting opener arm and a motor having a drive shaft, the improvement comprising that the opener arm is mounted on the drive shaft.

In a particular embodiment, the invention provides an automatic door opener for opening or closing a side hinged door, comprising a shaft, a motor driving the shaft, a slip clutch disposed upon the shaft, and an opener arm connected to such door, the opener arm having an opener hub disposed upon the slip clutch and in frictional engagement therewith. The frictional engagement is strong enough so that when the motor drives the shaft, the slip clutch impels the shaft and opener hub to rotate together to cause motion of such door, and the frictional engagement is weak enough that, should the motion of such door be impeded by an obstacle, the slip clutch allows the shaft and opener hub to rotate relative to one another, without the use of sensors, switches, torque controls and the like.

One aspect of the invention is to provide an automatic door opener comprising a drag brake connected to the slip clutch, wherein the drag exerted by the drag brake is sufficient to prevent motion of the slip clutch when the motor does not drive the shaft.

Another aspect of the invention is to provide an automatic door opener wherein the slip clutch comprises a clutch hub affixed to the shaft, a bearing surface upon which the opener hub is disposed, first and second friction discs disposed upon the clutch hub on opposing sides of the opener hub, and a first spring disposed against the first friction disc so as to urge the first friction disc into contact with the opener hub.

A further aspect of the invention is to provide an automatic door opener further comprising a controller electrically connected to the motor and a door position sensor electrically connected to the controller, the controller being responsive to the door position sensor to activate and deactivate the motor as appropriate.

A still further aspect of the invention is to provide an automatic door opener wherein, when the motor and electromagnetic drag brake are not activated, the drag of the motor upon the shaft is sufficient to prevent motion of the door.

A still further aspect of the invention is to provide an automatic door opener which may comprise a controller electrically connected to a motor. The controller may be responsive to a signal to activate the motor further, including a signal from a hand-held remote control.

Another aspect of the invention is to provide an automatic door opener which may comprise timers that control the length of time during which the motor is activated to open the door, inactivated while the door is open and activated to close the door.

Yet another aspect of the invention is to provide an automatic door opener that, in the event of a power outage, allows users to open and close the door manually.

DETAILED DESCRIPTION OF THE INVENTION AND PREFERRED EMBODIMENTS THEREOF

The present invention provides an automatic door opener for side hinged doors. The invention provides a motor connected via a clutch to swing an opener arm which in turn swings the door. The opener arm is mounted on an output shaft that directly drives the arm. According to one aspect of this invention, the clutch is mounted on the output shaft. According to another, separate aspect of this invention, the clutch and the hub of the opener arm are coaxially mounted on the drive shaft of the motor, i.e., the drive shaft of the motor serves as, or is at least coaxial with, the output shaft that drives the opener arm. This is in contrast to prior art designs in which slip clutches are mounted on intermediary gears in the drive train.

Figure 1:
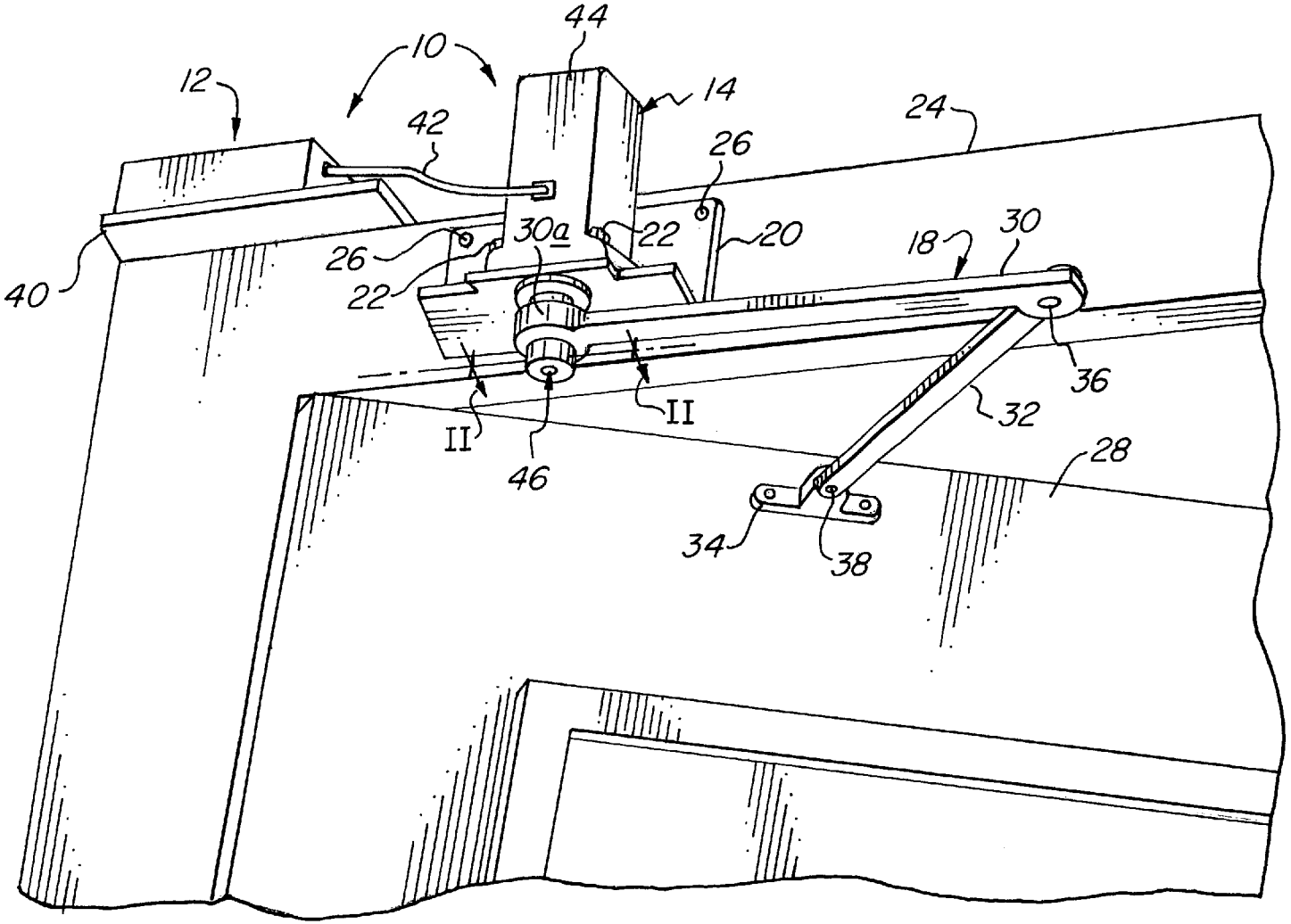
FIG. 1 is a perspective view of an automatic door opener mounted to a door frame and having its opener arm connected to a door in accordance with a first embodiment of the present invention.

Placement of the clutch on the output shaft constitutes a novel configuration (which may be referred to as a "direct-acting clutch") and it provides significant, previously unrecognized advantages over the placement of the clutch in other locations in the drive train. Specifically, by employing a direct-acting clutch, the overall construction of the opener mechanism can be simplified by the elimination of an intermediary gear in the drive train on which the clutch is mounted. Furthermore, when slippage occurs, it is generally at a much slower speed when the clutch is on the output shaft than when it is on an intermediary gear. As a result of the slower slip, the clutch lasts longer and has greater stability, lower heat build-up and less mechanical stress than would be experienced at a different location in the drive train. By mounting the clutch and the opener arm on the motor drive shaft, still further advantages are gained. These include a simplified design due to the elimination of any transfer or reduction gears between the motor drive shaft and the output shaft, increased ease of assembly because the clutch need not be built into a gear box comprising the intermediary gears and, in the case of a slip clutch, more uniform performance because the clutch is not exposed to the lubricants that are used with intermediary gear systems as it would be if it were situated in the gear box as shown, e.g., in U.S. Pat. No. 5,881,497 (FIG. 1). In addition, the elimination of the intermediary gear system means that torque is transferred more efficiently from the motor to the opener arm. Therefore, the torque rating of the motor can be more accurately balanced against the slip setting of the clutch. The clutch employed on the output shaft of the opener according to this invention may either be a friction or "slip" clutch (one embodiment of which is described herein with reference to FIGS. 1–3) or an electromagnetic clutch (two embodiments of which are described herein with reference to FIGS. 4 and 5, respectively).

Finally, the clutch and motor employed in a door opener according to this invention is chosen so that the door will not impose a large potentially injurious force on an obstacle (such as a person) that blocks the motion of the door and so that a person can easily backdrive the door against the impetus of the impetus of the motor if necessary.

Thus, an automatic door opener is provided which eliminates the need for sensors, switches, and the like disposed within the motor housing for preventing damage to the motor in the event of the door engaging an obstacle or obstruction. As used herein, an obstacle may include an article that is inadvertently left in a doorway or a person in the way of the door. In either case, motion of the door will be stopped (or may even be reversed by hand) while the motor continues to run, without causing damage thereto.

Previous designs utilizing rotating shafts and worm drives, partial nuts or ball screws suffer from various comparative disadvantages. Such designs are more suited to the high torque requirements of lifting garage doors vertically and are less sensitive to impediments in their path necessitating control means (discussed in reference to the prior art above) to sense blockage of the door and stop the motor. Known designs were not back-driven, meaning that the door could not be driven backwards against the motor independently of the motion of the drive shaft. The present design eliminates such mechanical or electronic control means, is well adapted to the side hinge doors of the typical residence or business, may be easily retrofit to such a door and may be easily back-driven. This allows an individual having a handicap rendering opening and closing of doors a challenge to more easily retrofit their existing domicile or business.

FIG. 1 shows a first preferred embodiment of a door opener 10 in accordance with the present invention. The door opener 10 comprises a controller 12, a motor 14, a slip clutch 46 and an opener arm 18. The door opener 10 is mounted to a mounting bracket 20 via fasteners 22 and, in turn, to a door frame 24 by fasteners 26. Alternatively, the motor and bracket may be mounted on the door and the opener arm mounted to the door frame.

The opener arm 18 is illustrated as being connected to a hinged door 28. The opener arm 18 may be composed of a metallic substance such as steel and includes a first arm 30, a second arm 32 and a bracket 34. Hinge pins 36, 38 are provided for articulated movement of the first arm 30, the second arm 32 and the bracket 34 during opening and closing of the hinged door 28. Opener arm 18 further includes an opener hub 30*a* being an integral part of the first arm 30. Opener arm 18 is mounted on drive shaft 50, which extends from motor 14 and which therefore serves as the output shaft of the opener mechanism.

The controller 12 is mounted on a block 40 and is connected to the motor 14 by a cable 42. The controller 12 energizes the motor 14 and is responsive to a sensor (not shown) for sensing a signal to open the door. The sensor may be a remote control infrared (IR) sensor, a remote control radio frequency (RF) sensor, a pressure sensor such as a button or footpad, or an optical sensor.

It will be understood that the electric motor 14 may be sized according to the dimensions and weight of the hinged door 28 and may include an optional gear train (not shown) disposed within a casing 44 of the motor 14. The gear train would provide a proper reduction (for example, 360:1) in output drive of the motor 14 necessary to move the hinged door 28 at an appropriate speed. Use of the gear train would also allow reduction in the size and power of the motor 14 necessary to permit manual movement of the door 28 even when the motor is deactivated or to permit a person to backdrive the door against the impetus of the motor, if needed.

Figure 2:
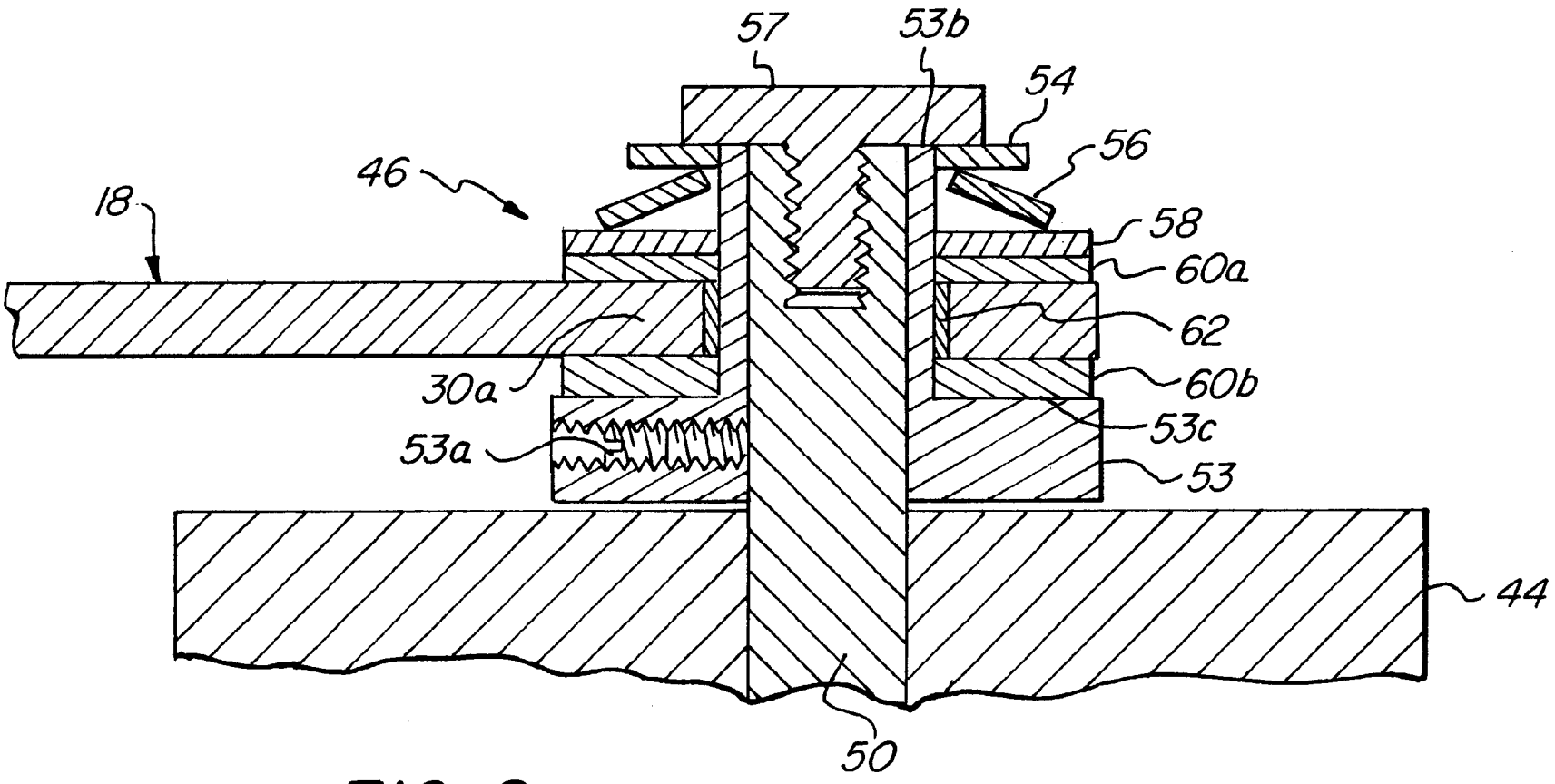
FIG. 2 is an enlarged cross-sectional view of the clutch assembly of the door opener of FIG. 1 taken along line II—II of FIG. 1.

Referring now to FIG. 2, the slip clutch 46 is disposed on a drive shaft 50. Slip clutch 46 includes a clutch hub 53 which may be affixed to the drive shaft 50 via set screw 53*a* and includes a stepped configuration of clutch hub 53 creating an area of reduced cross section 53*b* and a shoulder 53*c*. The clutch hub 53 may be composed of a strong and durable material such as metal. Along the area of reduced cross section 53*b*, there are a retaining ring 54, a spring 56, a drag washer 58, a pair of friction discs 60*a*, 60*b* and a thin sleeve-like bearing 62 upon which the opener hub 30*a* of opener arm 18 is disposed. Alternatively, friction disc 60*b* and thin bearing 62 may be an integrated body. Friction discs

60*a* and 60*b* have coefficients of friction which are selected in a manner well-known to those skilled in the art, to allow reliable rotation of opener hub 30*a* and yet allow opener hub 30*a* to move in relation to friction discs 60*a* and 60*b* when an obstacle is encountered or the door is back-driven.

Figure 2A:
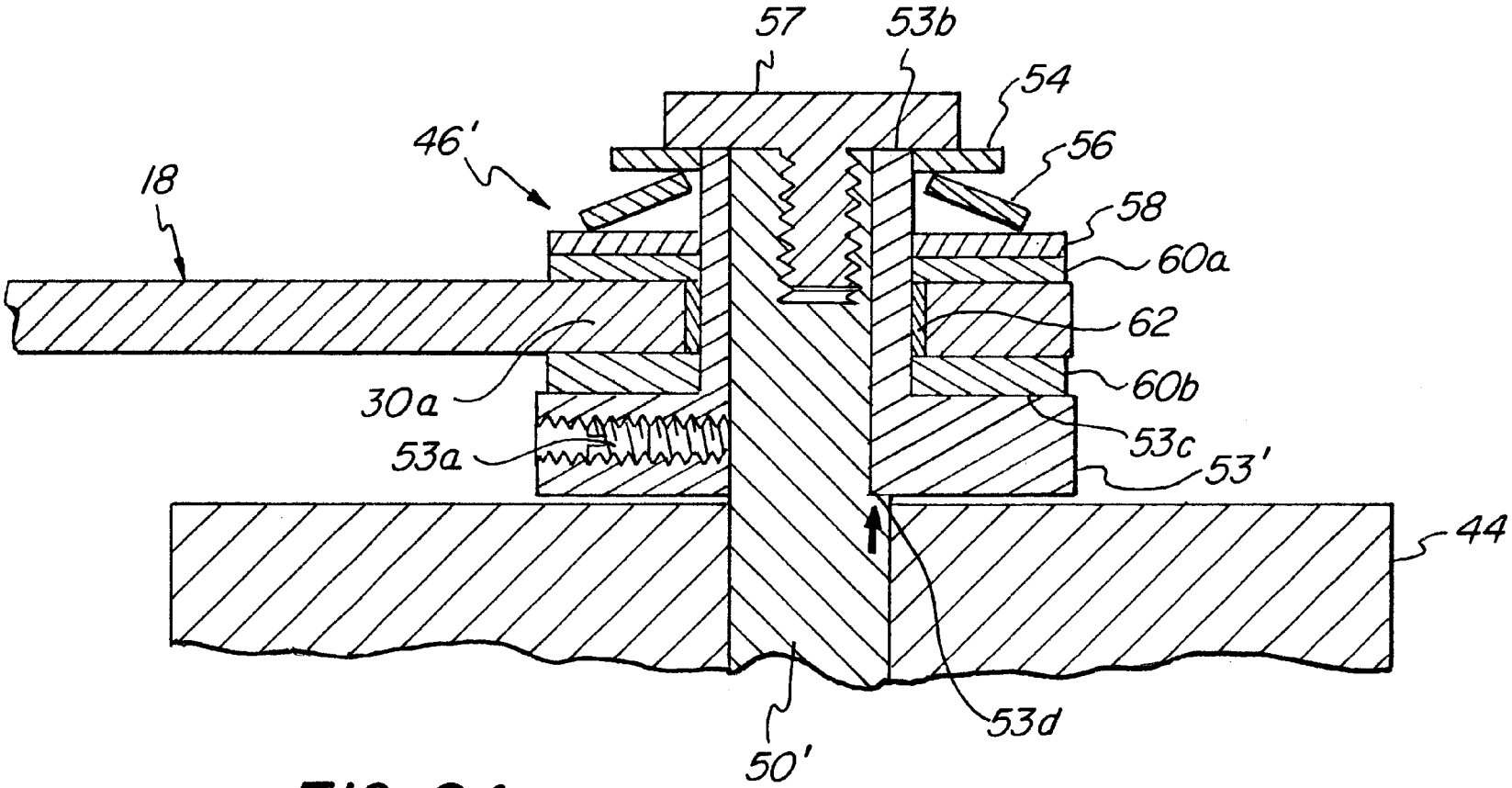
FIG. 2A is a view similar to FIG. 2 of a clutch assembly in which the clutch hub is keyed to the output shaft.

A retainer cap 57 is threadably mounted on the end of drive shaft 50. Retainer cap 57 provides a flange against which a retaining ring 54 bears. The retaining ring 54 provides a stop for a spring 56. The spring 56 may comprise a Belleville washer and functions to press the drag washer 58 against the friction disc 60*a*. The opener hub 30*a* of opener arm 18 is sandwiched between the friction discs 60*a*, 60*b*. The friction discs 60*a* and 60*b* function to bear against the opener hub 30*a* to cause movement of the opener arm 18 coincidental to the motion of drive shaft 50. The friction discs 60*a*, 60*b* may be composed of metal and in addition to the frictional requirements discussed previously, the material of the friction discs should be selected to minimize undesirable noise (squeal) and provide a maximum life span measured in cycles of duty. The thin bearing 62 is provided to allow relative movement of the opener arm 18 about the clutch hub 53 when the door 28 (FIG. 1) is stopped but the motor 14 (also FIG. 1) continues driving the drive shaft 50. The bearing 62 may be composed of, for example, a metallic or plastic substance. FIG. 2A illustrates a slip clutch 46' which is substantially similar in construction to slip clutch 71, and in the Figure, structures that are the same as those in clutch 46 of FIG. 2 are identically numbered. In clutch 46', the clutch hub 53' is keyed to the drive shaft 50' by an axial flange 53*d*. The keying arrangement reduces the load carried by set screw 53*a*, or may obviate the need for set screw 53*a* completely. The operation of clutch 46' is the same as clutch 46.

In operation, the spring 56 applies pressure to the drag washer 58 which, in combination with shoulder 53*c*, presses the friction discs 60*a*, 60*b* adjacent the opener hub 30*a*, causing an operative connection between the clutch hub 53 and the opener arm 18. Accordingly, when motor 14 (FIG. 1) is operating, drive shaft 50 will move the opener arm 18 and, in turn, the hinged door 28 (FIG. 1) will occur. If the hinged door 28 hits an obstacle (not shown), for example, an article dropped on the floor in the path of the hinged door 28, the opener arm 18 will stop moving and the friction between the opener hub 30*a* and friction discs 60*a* and 60*b* will be overcome and opener hub 30*a* will ride on bearing 62 as shaft 50 and clutch hub 53 continue to move. By selecting friction discs 60*a* and 60*b* that have a coefficient of dynamic friction close to the value of the coefficient of static friction, excessive recoil and bounce can be eliminated when the door encounters an obstacle. In addition, in the event that power to the motor 14 is lost, the hinged door 28 may be hand-operated to overcome the friction between the friction discs 60*a*, 60*b* and the opener hub 30*a*.

During a typical cycle of use, controller 12 will energize motor 14 in response to a signal from a sensor (not shown) such as a pressure sensor, optical sensor or remote control. Motor 14 will rotate shaft 50 and slip clutch 46, thus causing opener arm 18 to open door 28. Controller 12 will stop motor 14 after a pre-programmed time. The length of time during which controller 12 energizes motor 14 for opening the door can be controlled with a simple timing circuit such as a resistance-capacitance (RC) circuit; by the use of a variable potentiometer, this circuit can be made easily adjustable, another assist to easy retrofitting.

In another embodiment of the invention, the operation of the motor for the opening of the door is responsive to a magnetic switch that indicates that the door has reached the desired open position. For example, a magnet may be mounted on the opener arm near the output shaft and the magnetic switch may be mounted on the motor casing. The magnet and the switch are positioned so that when the opener arm has moved the door to the desired position, the magnet trips the switch. In response, the control circuitry for the door opener stops the motor. Thus, the period of time during which the motor turns to open the door (the "door open interval") lasts until the desired open position is attained. The drag in motor 14 will hold the hinged door 28 open, even though motor 14 is stopped, until the controller 12 reverses the direction of the motor 14 and closes the hinged door 28. A timer circuit having a RC circuit that includes a variable potentiometer may be used to control the length of time the door remains open (the "hold open interval") in response to the needs of the user and other concerns such as security, environment and privacy. At the end of the hold open interval, the control circuitry may reverse the motor to close the door for an interval (the "door close interval") determined by another timer circuit (the "door close timer"). The door close timer may comprise a RC circuit with a fixed R value. If, during this cycle, door 28 hits an obstacle, opener hub 30*a* will break its frictional engagement with the clutch shoulder 53*c* and drag washer 58 (via friction discs 60*a* and 60*b*), thus allowing drive shaft 50 and clutch hub 53 to continue rotating and thus avoiding the possibility of damage to motor 14. The driven member of the invention, opener arm 18, thereafter rides on thin bearing 62 and friction discs 60*a* and 60*b* until the obstacle is removed or the timer stops the motor. Should an obstacle prevent the door from closing for the entire door close interval, it will remain open until the obstacle is removed and the open, hold and close processes are repeated.

In other embodiments, the use of variable potentiometers in the timer circuits that control the door open, hold open and door close intervals permits the user to adjust them as desired.

Unlike prior art door openers, the invention does not require a torque sensor or other means for deactivating motor 14 when an obstacle is encountered. The invention also does not require a manual control for interrupting the drive train in order to open or close the door when motor 14 is not operating. The elimination of various electrical and mechanical components such as door position sensors, torque sensors, manual clutches, manual interruptions and so on make the device easier to manufacture and easier to install and use, with consequent savings of cost.

Figure 3:
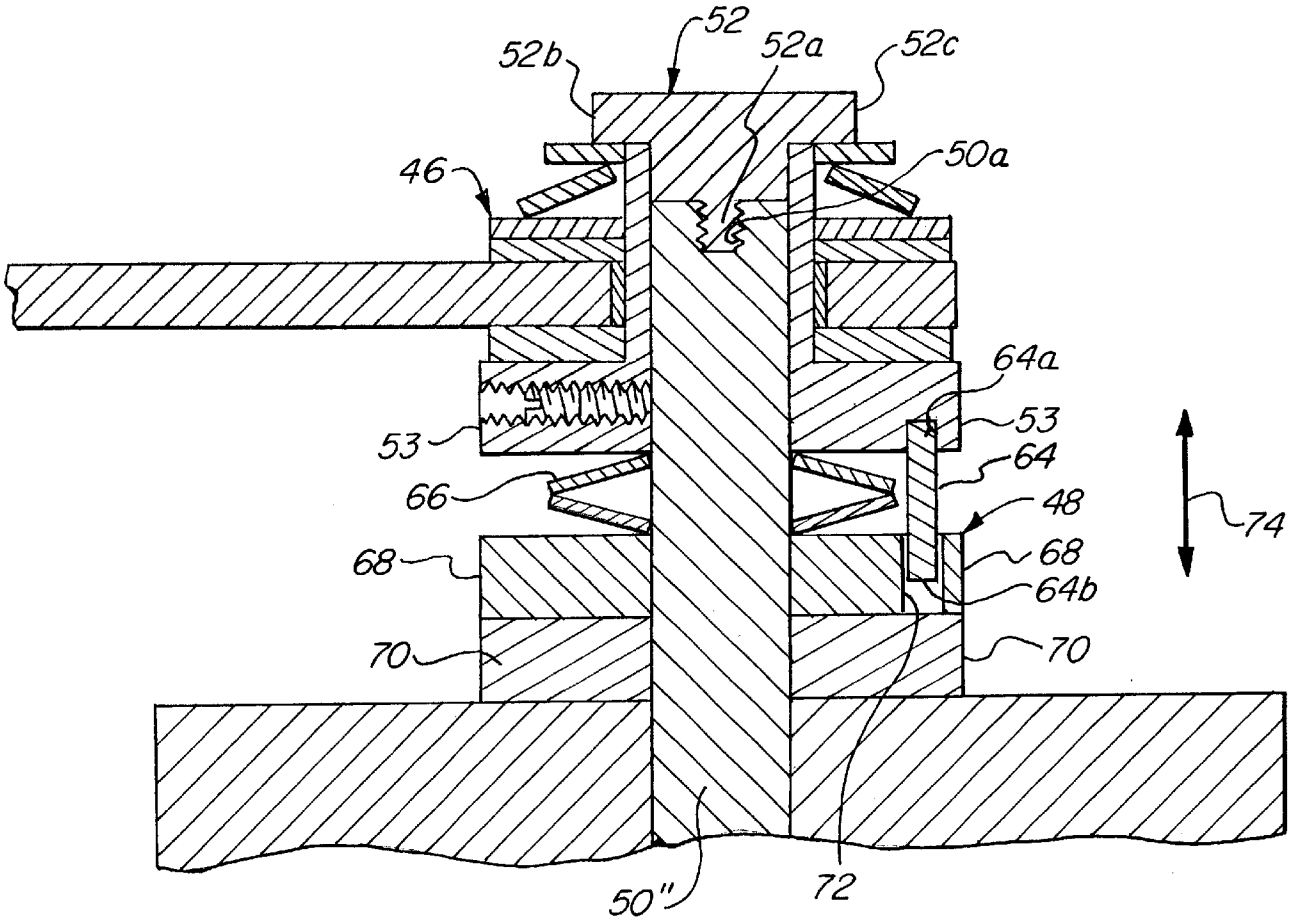
FIG. 3 is an enlarged cross-sectional view of a clutch and brake assembly of a second embodiment of the present invention.

FIG. 3 illustrates a second embodiment of the invention having clutch and brake assembly 16. The slip clutch 46 is as shown in the previous embodiment. In this embodiment, the drive shaft 50" comprises a threaded bore 50*a* and a retainer cap 52, fastened to threaded slot 50*a* by means of threaded portion 52*a*. Retainer cap 52 is generally T-shaped in cross section and has flanges 52*b* and 52*c*.

The drag brake 48 is operatively connected to the clutch hub 53 via a pin 64 and includes a spring 66, a brake plate 68 and a stationary plate 70. The pin 64 comprises a fixed end 64*a* and a free end 64*b*. The fixed end 64*a* is connected to the clutch hub 53 and the free end 64*b* is disposed within a cavity 72 of the brake plate 68. Accordingly, the pin 64 may translate a rotational force to the brake plate 68 as received from the clutch hub 53, yet allow linear movement of the brake plate 68 and clutch hub 53 in the directions of arrow 74.

Spring 66 is provided for pressing the brake plate 68 against the stationary plate 70, thus applying a drag force to the clutch hub 53 and in turn to the opener hub 30a. It will be appreciated that the tension and/or type of the spring 66 may be varied in order to provide a desired amount of drag on the movement of opener hub 30*a* (FIG. 2). The brake plate 68 may be composed of any suitably strong material such as a metallic composition.

In operation, the controller 12 (FIG. 1) will respond to a signal and open the hinged door 28, as described above in relation to the first embodiment, and the motor 14 will function to overcome the drag caused by the drag brake 48 until the hinged door 28 is fully open. Once the hinged door 28 is fully open, the motor 14 will be stopped and the drag brake 48 will maintain the hinged door 28 in the open position until the controller 12 reverses the direction of the motor 14 and closes the hinged door 28. Should there be a power loss to the motor 14, the drag brake 48 will retain the hinged door 28 in its position at the time of power loss unless it is hand-operated. As in the first embodiment, the clutch and brake assembly 16 are designed to permit the door to be moved by hand.

Figure 4:
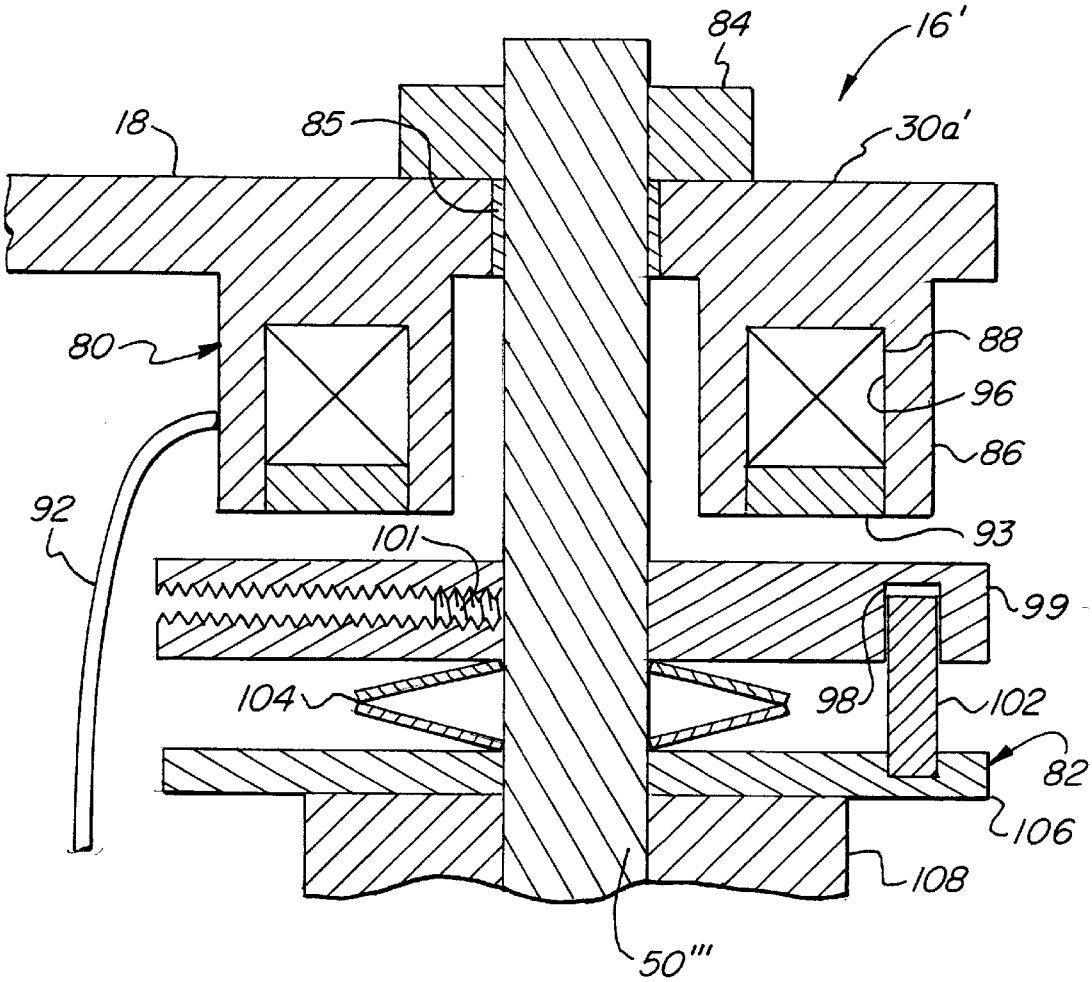
FIG. 4 is an enlarged cross-sectional view of a clutch and brake assembly of a third embodiment of the present invention.

Another embodiment of a clutch and brake assembly 16' is illustrated in FIG. 4. The clutch and brake assembly 16' includes an electromagnetic clutch 80, a drag brake 82 and mounting cap 84. A thin bearing 85 functions as a bearing surface to support opener arm 18.

The electromagnetic clutch 80 includes a field cup 86, a coil 88 and a lead wire 92. The field cup 86 includes opener hub 30*a*', a frictional material 93 and a receiving slot 96 wherein the coil 88 is disposed. Armature plate 99 has cavity 98 for engagement with the optional drag brake 82 as discussed below. Armature plate 99 is keyed to shaft 50''' with setscrew 101. The lead wire 92 is connected to a controller (not shown) for control of energization of the coil 88. In this embodiment, opener arm 18 and electromagnetic clutch 80 are fixed together, and armature plate 99 is magnetically attractable, i.e., composed of a sufficient quantity of magnetizable material such that, when the coil 88 is energized via controller 12, the armature plate 99 will move upwards (as sensed in FIG. 4) and be clamped against the frictional material 93 and the field cup 86. In this way, drive shaft 50''' will be directly engaged with opener hub 30*a*'. When coil 88 is not energized, opener hub 30*a*' will be freely movable on bearing 85.

During the course of repeated cycles of operation, shaft 50''' precesses. Armature plate 99 and drag brake 82, being fixed to the shaft 50'' via setscrew 101, precess with shaft 50''' , while electromagnetic clutch 80, being fixed to opener hub 30*a* and opener arm 18, does not, and thus lead wire 92 does not wrap around shaft 50''.

Drag brake 82 may be similar to the drag brake 48 previously described and comprises a pin 102, a spring 104, a brake plate 106 and a stationary plate 108. The pin 102 is fixed to the brake plate 106 and is linearly movable within the cavity 98 of armature plate 99. The brake plate 106 is biased by a spring 104 adjacent the stationary plate 108 in order to provide constant drag force on the opener arm 18 when the coil 88 is energized.

The electromagnetic clutch 80 may be controlled by the controller 12 (FIG. 1) such that, when the motor 14 (FIG. 1) is energized, the coil 88 is also energized, enabling movement of the opener hub 30*a*' of opener arm 18 as described above. Upon engaging an obstacle, the clamping force provided by the coil 88 between frictional material 93 and the armature plate 99 may be overcome, so that drive shaft 50''' may continue to rotate while opener arm 18 remains stationary on bearing 85. The frictional engagement between frictional material 93 and armature plate 99 may be nevertheless strong enough to overcome drag on the door induced by wind or weather-stripping.

Controller 12 may be actuated by, for example, footpads, however, it is preferable to use a remote control, keypad or similar device.

In the event of complete power loss, electromagnetic clutch 80 and armature plate 99 disengage, allowing the door to move freely with little or no extra drag in comparison to the same door prior to installation of the opener. In the event of failure of motor 14, the frictional engagement between frictional material 93 and armature plate 99 may be overcome and the door may be back-driven or otherwise hand-operated while subject to the effect of electromagnetic clutch 80.

Figure 5:
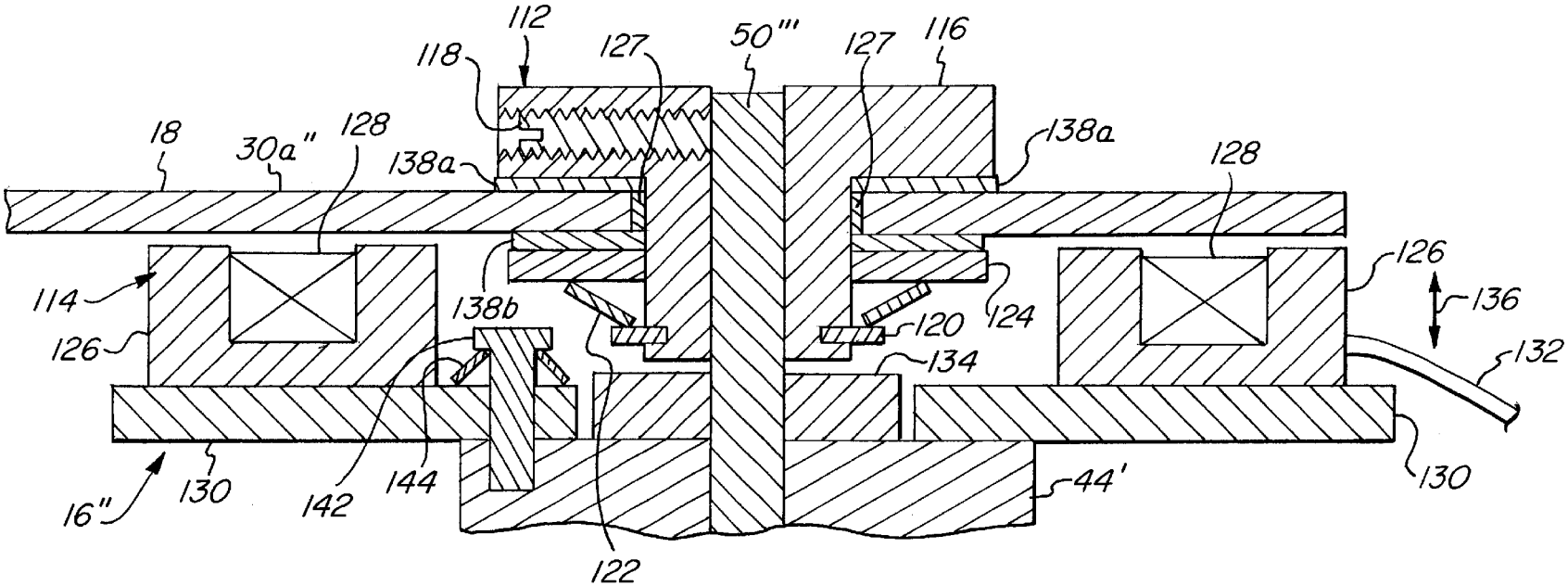
FIG. 5 is an enlarged cross-sectional view of a clutch and brake assembly of a fourth embodiment of the present invention.

A further embodiment of a clutch and brake assembly is generally illustrated at 16'' in FIG. 5. In this embodiment a slip clutch 112 is provided along with an optional electromagnetic brake 114. The slip clutch 112 is similar to the slip clutch 46 described above (see FIG. 2) although when compared to that previous embodiment, it can be seen that slip clutch 112 is mounted in the opposite orientation relative to the drive shaft 50''' . The slip clutch 112 includes a clutch hub 116 that is affixed to the drive shaft 50''' via a setscrew 118. The slip clutch 112 also includes a retaining ring 120, a spring 122, a drag washer 124, a pair of friction discs 138*a* and 1381*b* and a thin bearing 127.

The electromagnetic brake 114 comprises a field cup 126, a coil 128, a mounting plate 130 and a lead wire 132. The lead wire 132 may be connected to the controller 12 (FIG. 1) for control of the clutch and brake assembly 16''. The mounting plate 130 may be affixed to the motor casing 44 (FIG. 1) via any suitable means, for example, by means of a set screw (not shown), and may be disposed adjacent to a stationary plate 134. Shoulder bolt 142, which has wave washer 144, allows motion of electromagnetic brake 114 as shown by arrow 136.

In operation, the friction discs 138*a*, and 138*b* are urged against the opener hub 30*a*'' by the spring 122 with sufficient force that the drive shaft 50''' is operatively connected thereto. Electromagnetic brake 114 functions to clamp the opener hub 30*a*'', which is composed at least partially of a magnetic substance, and thereby prevents opener arm 18 from moving. In particular, the opener arm 18 is clamped adjacent to the field cup 126 as it moves along the direction of arrow 136. The electromagnetic brake 114 may provide more braking power than the drag brakes previously described, and thus may hold a door of heavy weight clamped in place in response to energization of the coil 128 by the controller 12 (FIG. 1).

When electromagnetic brake 114 is energized, the force exerted by wave washer 144 is overcome and electromagnetic brake 114 clamps opener hub 30*a*''. Upon de-energization of coil 128, wave washer 144 urges electromagnetic brake 114 away from opener hub 30*a*''. In the event of a power loss, electromagnetic brake 114 is thus entirely disengaged, allowing the door to be back-driven or otherwise manually operated merely by overcoming the frictional engagement of friction discs 138*a* and 138*b* with opener hub 30*a*''.

While the invention has been described in detail with respect to specific preferred embodiments thereof, numerous modifications to these specific embodiments will occur to those skilled in the art upon a reading and understanding of the foregoing description; such modifications are embraced within the scope of the present invention.

What is claimed is:

1. In a motorized door opener comprising a motor having a drive shaft, an output shaft comprising the drive shaft, an opener arm mounted on the output shaft and a clutch, the improvement comprising that the clutch comprises a clutch hub mounted on the output shaft for rotation therewith; the opener arm comprises an arm hub on the output shaft and the clutch comprises a friction disc drivably mounted on the output shaft adjacent to the arm hub and pressure means for causing the friction disc to bear on the arm hub for transfer of rotation of the output shaft to the opener arm;

wherein the pressure means comprises a spring on the output shaft and a retaining ring on the output shaft against which the spring can bear.

2. The improved door opener of claim 1 further comprising a drag brake.

3. The improved door opener of claim 2 comprising an electromagnetic drag brake.

4. In a motorized door opener comprising a motor having a drive shaft, an output shaft comprising the drive shaft, an opener arm mounted on the output shaft and a clutch, the improvement comprising that the opener arm comprises an arm hub on the output shaft, the clutch comprising an electromagnetic coil on the arm hub, a drag brake connected to the output shaft and an armature connected to the drag brake and movably mounted on the output shaft for clamping to the arm hub when the electromagnetic coil is energized.

* * * * *